US009821445B2

(12) United States Patent
Huang

(10) Patent No.: US 9,821,445 B2
(45) Date of Patent: Nov. 21, 2017

(54) REMOVAL DEVICE FOR BELT PULLEY

(71) Applicant: Chuan Mao Huang, Taichung (TW)

(72) Inventor: Chuan Mao Huang, Taichung (TW)

( * ) Notice: Subject to any disclaimer, the term of this patent is extended or adjusted under 35 U.S.C. 154(b) by 47 days.

(21) Appl. No.: 14/622,947

(22) Filed: Feb. 16, 2015

(65) Prior Publication Data

US 2016/0236336 A1 Aug. 18, 2016

(51) Int. Cl.
*B25B 27/02* (2006.01)
*B25B 27/06* (2006.01)

(52) U.S. Cl.
CPC ..... *B25B 27/023* (2013.01); *B25B 27/062* (2013.01)

(58) Field of Classification Search
CPC ..... B25B 1/10; B25B 1/103; B25B 1/2452; B25B 1/2489; B25B 5/00–5/06; B25B 5/067–5/068; B25B 5/10–5/102; B25B 5/109; B25B 5/163
See application file for complete search history.

(56) References Cited

U.S. PATENT DOCUMENTS 685,078 A * 10/1901 Willringhaus ..... B25B 5/006 269/120
1,064,400 A * 6/1913 Timmins ..... B25B 27/023 29/259
1,172,761 A * 2/1916 Berkstresser ..... B25B 27/023 29/259
1,227,457 A * 5/1917 Langan ..... B25B 27/023 29/259
2,077,254 A * 4/1937 Nestler ..... B25B 27/023 29/259
2,114,227 A * 4/1938 Kriss ..... B25B 5/101 269/143
2,881,645 A * 4/1959 Kruchten ..... B25B 1/10 269/181
3,568,294 A * 3/1971 Conner ..... B25B 27/023 29/259
3,689,978 A * 9/1972 Kelso ..... B25B 27/023 29/259
3,861,664 A * 1/1975 Durkee ..... A63C 11/02 269/153
D252,255 S * 7/1979 Uyeda ..... D8/394
4,798,371 A * 1/1989 Wallisser ..... B25B 1/2452 269/283
5,098,145 A * 3/1992 Goldberg ..... B25B 1/2405 269/264
5,139,246 A * 8/1992 Yakou ..... B25B 1/18 269/242

(Continued)

*Primary Examiner* — Larry E Waggle, Jr.
*Assistant Examiner* — Tyrone V Hall, Jr.

(57) ABSTRACT

A removal device for a belt pulley contains: a guiding rod, two clamping members, and two paws. The guiding rod includes a screwing hole defined on a central position thereof to screw with a push rod. The two clamping members slide along the guiding rod, and each clamping member includes a guide orifice for inserting the guiding rod, a first guide rail, and a first engaging portion, wherein a first direction of the first guide rail is perpendicular to a second direction of the screwing hole. Each paw includes a second guide rail for matching with the first guide rail, such that each of the two paws is connected with or removed from each of the two clamping members, wherein the second guide rail has a second engaging portion for cooperating with the first engaging portion.

6 Claims, 8 Drawing Sheets

(56) References Cited

U.S. PATENT DOCUMENTS

| | | | | |
|---|---|---|---|---|
| 5,551,676 | A * | 9/1996 | Tibbet | B25B 1/103 269/154 |
| 6,266,859 | B1 * | 7/2001 | Hernandez | B25B 27/023 29/256 |
| D592,481 | S * | 5/2009 | Helmetschlager | D8/72 |
| 7,685,688 | B2 * | 3/2010 | Fan | B66F 3/36 29/256 |
| 7,770,277 | B2 * | 8/2010 | Wridt | B25B 27/023 29/255 |
| 8,745,832 | B2 * | 6/2014 | Barrios | B25B 27/02 269/143 |
| 2013/0318639 | A1 * | 11/2013 | Gulick, Jr. | G08B 13/1445 726/35 |

* cited by examiner

REMOVAL DEVICE FOR BELT PULLEY

FIELD OF THE INVENTION

The present invention relates to a removal device for a belt pulley in which two paws are replaced easily and quickly.

BACKGROUND OF THE INVENTION

A conventional removal device for a belt pulley is disclosed in TW Patent No. 102220397, but it two paws are removed troublesomely, after removing the other components of the removal device.

The present invention has arisen to mitigate and/or obviate the afore-described disadvantages.

SUMMARY OF THE INVENTION

The primary object of the present invention is to provide a removal device for a belt pulley in which two paws are replaced easily and quickly.

To obtain the above objects, a removal device for a belt pulley provided by the present invention contains: a guiding rod, two clamping members, and two paws.

The guiding rod includes a screwing hole defined on a central position thereof to screw with a push rod.

The two clamping members slide along the guiding rod, and each clamping member includes a guide orifice for inserting the guiding rod, a first guide rail, and a first engaging portion, wherein a first direction of the first guide rail is perpendicular to a second direction of the screwing hole.

Each paw includes a second guide rail for matching with the first guide rail, such that each of the two paws is connected with or removed from each of the two clamping members, wherein the second guide rail has a second engaging portion for cooperating with the first engaging portion.

DETAILED DESCRIPTION OF THE PREFERRED EMBODIMENTS

Figure 1:
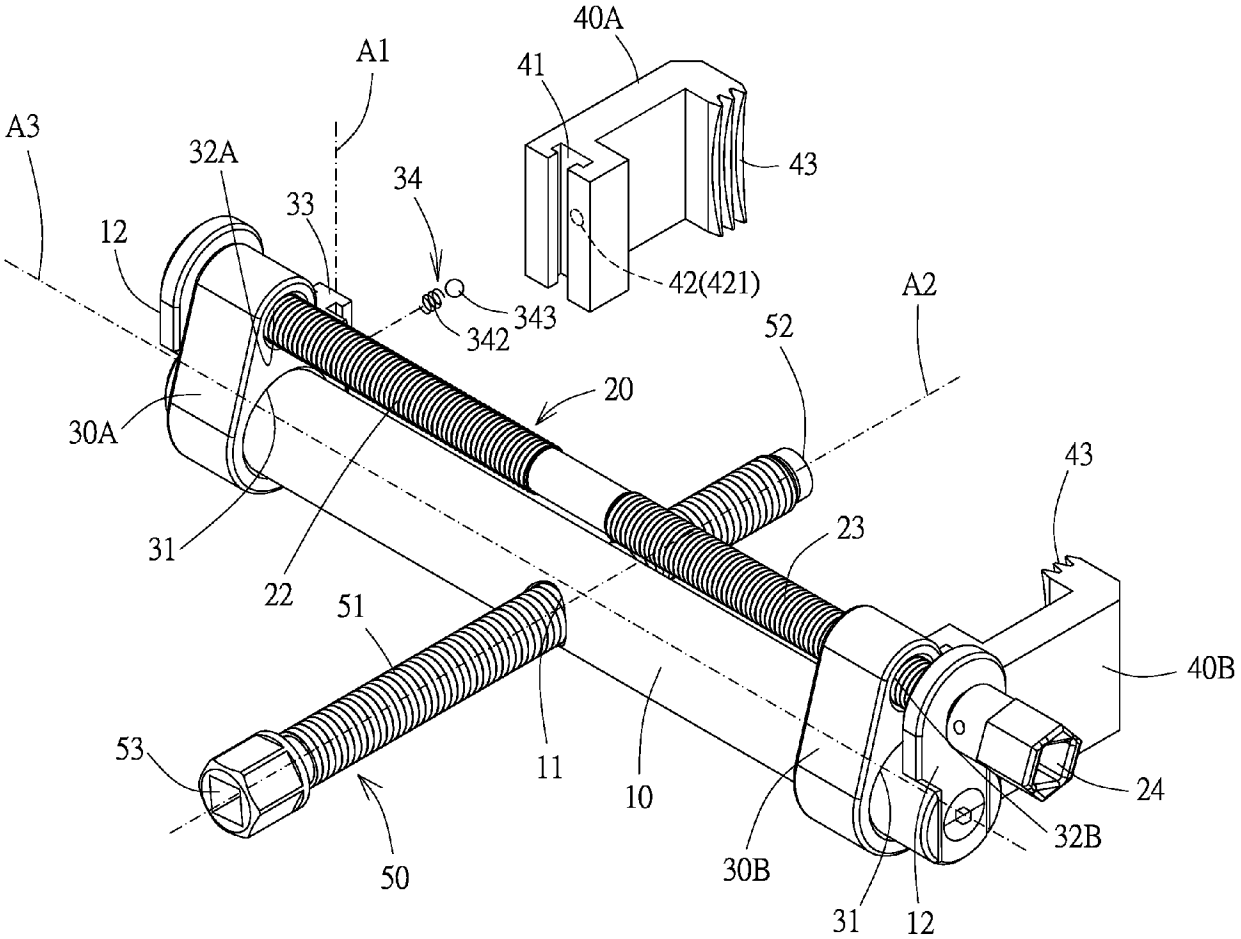
FIG. 1 is a perspective view showing the exploded components of a part of a removal device for a belt pulley according to a preferred embodiment of the present invention.
Figure 2:
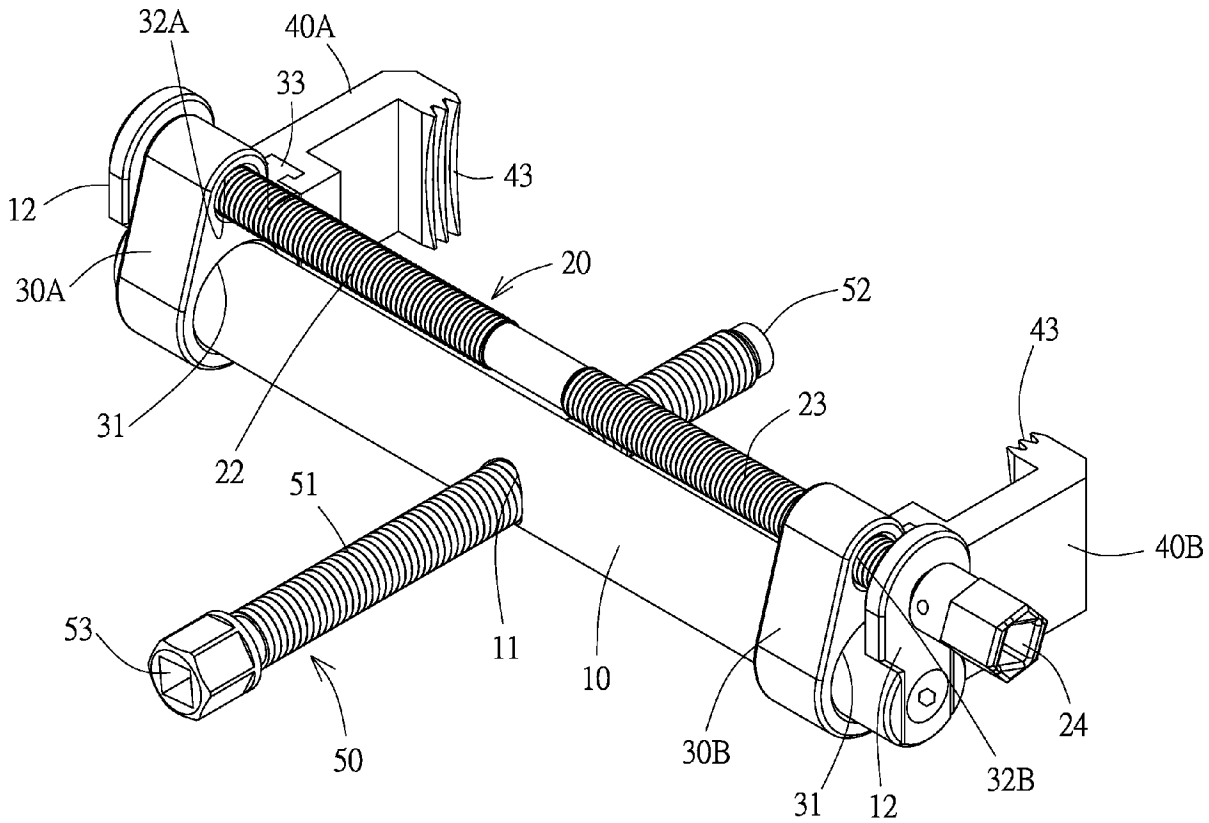
FIG. 2 is a perspective view showing the assembly of the removal device for the belt pulley according to the preferred embodiment of the present invention.

With reference to FIGS. 1 to 4, a removal device for a belt pulley according to a preferred embodiment of the present invention comprises: a guiding rod 10, a screw rod 20, two clamping members 30A, 30B, two paws 40A, 40B, and a push rod 50.

The guiding rod 10 includes a screwing hole 11 defined on a central position thereof and includes two bearing holders 12 mounted on two ends thereof.

The screw rod 20 is parallelly fixed on the guiding rod 10 and its two ends insert through and connect with the two bearing holders 12, the screw rod 20 includes two locking rings 21 mounted inside the two bearing holders 12 to limit a movement of the screw rod 20, the screw rod 20 also includes a first threaded section 22 and a second threaded section 23 which are formed on the two ends thereof to screw with the two bearing holders 12, wherein one of the two ends of the screw rod 20 is inserted through one of the two bearing holders 12 and has a first forcing portion 24 for being rotated by a hand tool, such that the hand tool rotates the screw rod 20.

Each of the two clamping members 30A, 30B includes a guide orifice 31 for inserting the guiding rod 20, such that each of the two clamping members 30A, 30B slides along a first direction A3 of the guiding rod 10, wherein a first clamping member 30A has a first threaded aperture 32A for screwing with a first threaded section 22, and a second clamping member 30B has a second threaded aperture 32B for screwing with a second threaded section 23, such that the first clamping member 30A and the second clamping member 30B are symmetrically located beside two sides of the screwing hole 11 so that the screw rod 20 drives the first clamping member 30A and the second clamping member 30B to move close to or away from each other along the guiding rod 10. Furthermore, each of the first clamping member 30A and the second clamping member 30B further includes a first guide rail 33 in a T shape, and a second direction A1 of the first guide rail 33 is perpendicular to a third direction A2 of the screwing hole 11 and the first direction A3 of the guiding rod 10. The first guide rail 33 has a first engaging portion 34 in which a first dead pore 341 is defined to accommodate a spring 342 and a positioning ball 343 pushed by the spring 342, such that a part of the positioning ball 343 extends out of the first dead pore 341.

Figure 5:
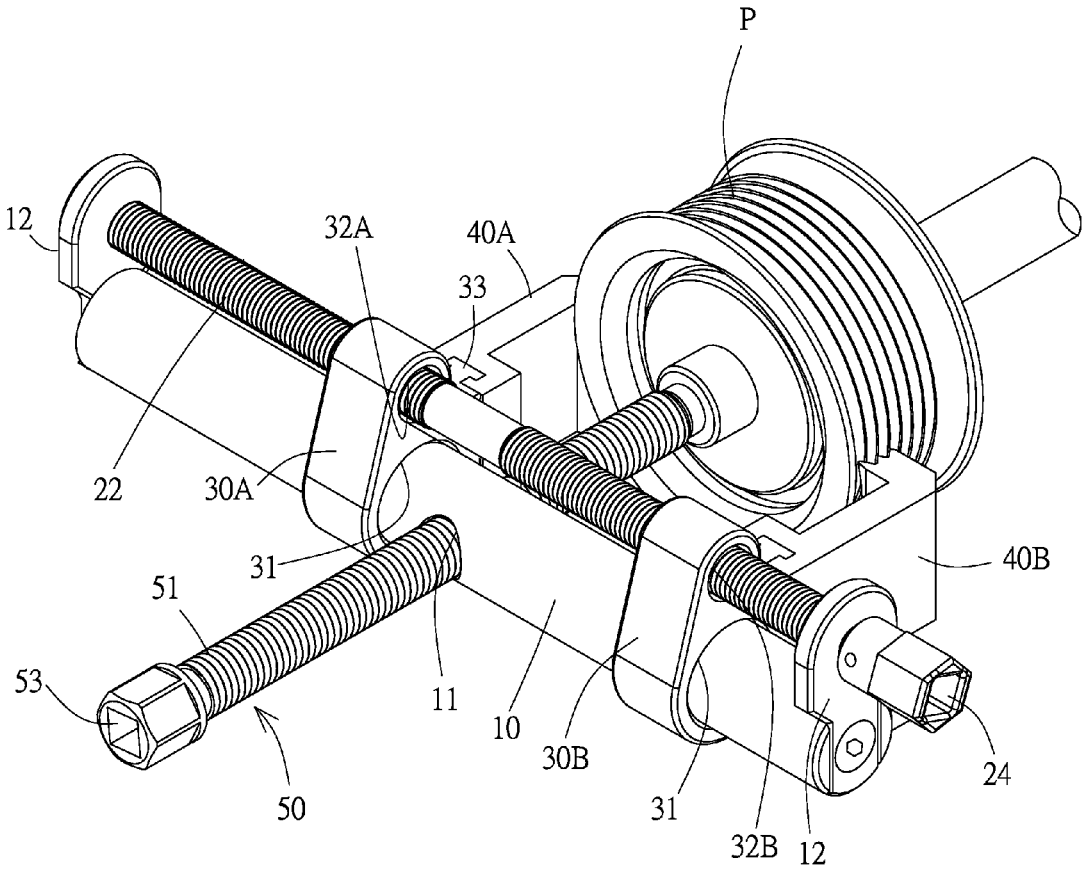
FIG. 5 is a cross sectional view showing the operation of the removal device for the belt pulley according to the preferred embodiment of the present invention.
Figure 6:
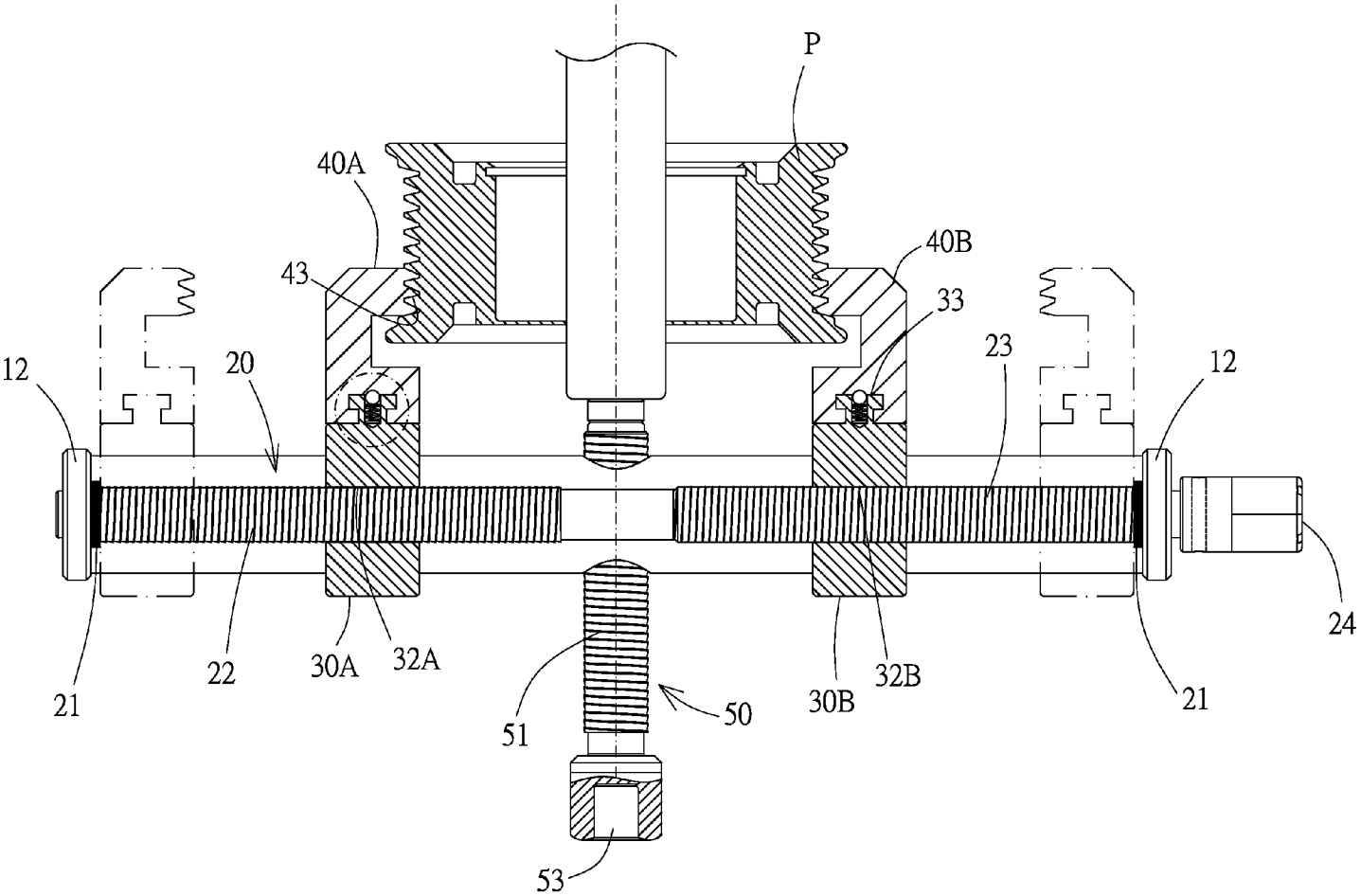
FIG. 6 is another cross sectional view showing the operation of the removal device for the belt pulley according to the preferred embodiment of the present invention.

Each of the two paws 40A, 40B includes a second guide rail 41 for matching with the first guide rail 33, such that each of the two paws 40A, 40B is connected with or removed from each of the two clamping members 30A, 30B, wherein the second guide rail 41 has a second engaging portion 42 for cooperating with the first engaging portion 34, and the second engaging portion 42 has a second dead pore 421 defined therein to retain with the positioning ball 343, such that the first paw 40A is connected with the first clamping member 30A, and a second paw 40B is coupled with the second clamping member 30B. Each of the first paw 40A and the second paw 40B further includes a retaining portion 43, as shown in FIGS. 5 and 6, when the screw rod 20 drives the first clamping member 30A and the second clamping member 30B to move close to each other, the retaining portion 43 retains with a belt slot of a belt pulley P.

Figure 7:
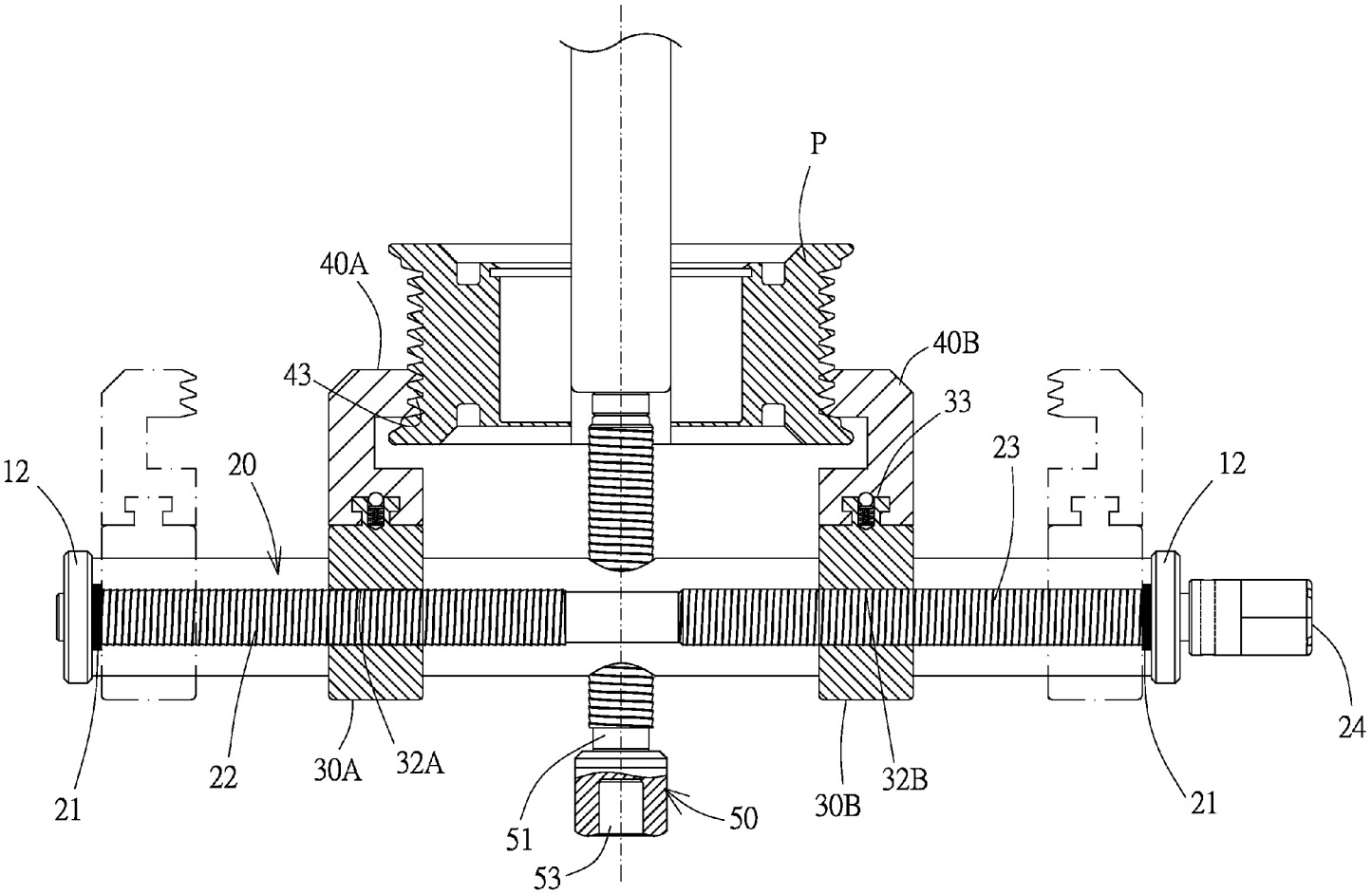
FIG. 7 is also another cross sectional view showing the operation of the removal device for the belt pulley according to the preferred embodiment of the present invention.

The push rod 50 includes a third threaded section 51 inserting through and screwing with the screwing hole 11, the push rod 50 also includes an abutting portion 52 defined on a first end thereof between the first clamping member 30A and the second clamping member 30B and includes a second forcing portion 52 formed on a second end thereof and rotated by the hand tool. Referring further to FIG. 7, when two retaining portions 43 engage with the belt pulley P, the second forcing portion 52 of the push rod 50 is rotated to push a transmission shaft for fixing the belt pulley P, and the hand tool drives the push rod 50 to move along the screwing hole 11, hence the two retaining portions 43 are applied to remove the belt pulley P.

Figure 3:
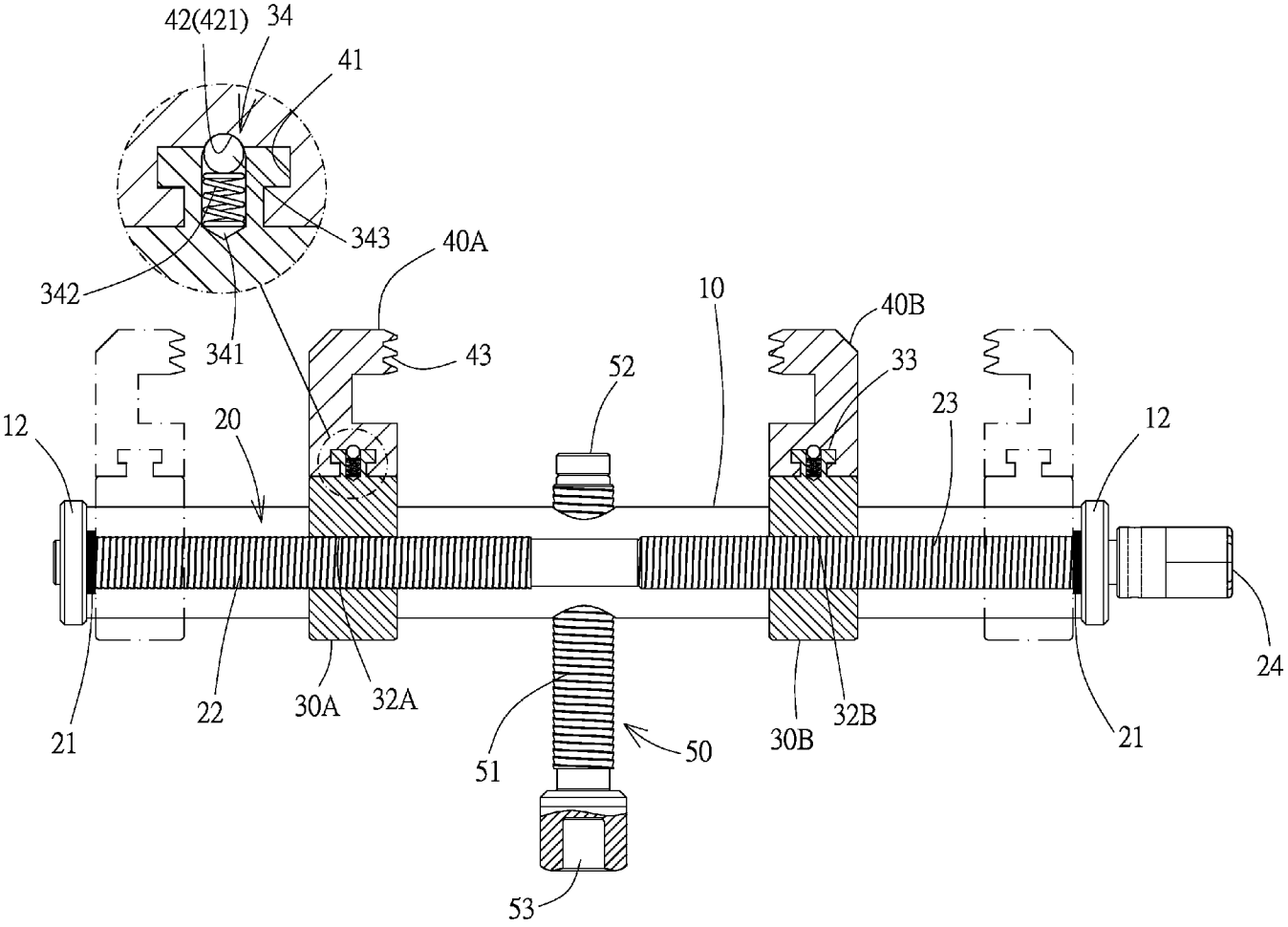
FIG. 3 is a cross sectional view showing the assembly of two clamping members and two paws of the removal device for the belt pulley according to the preferred embodiment of the present invention.
Figure 4:
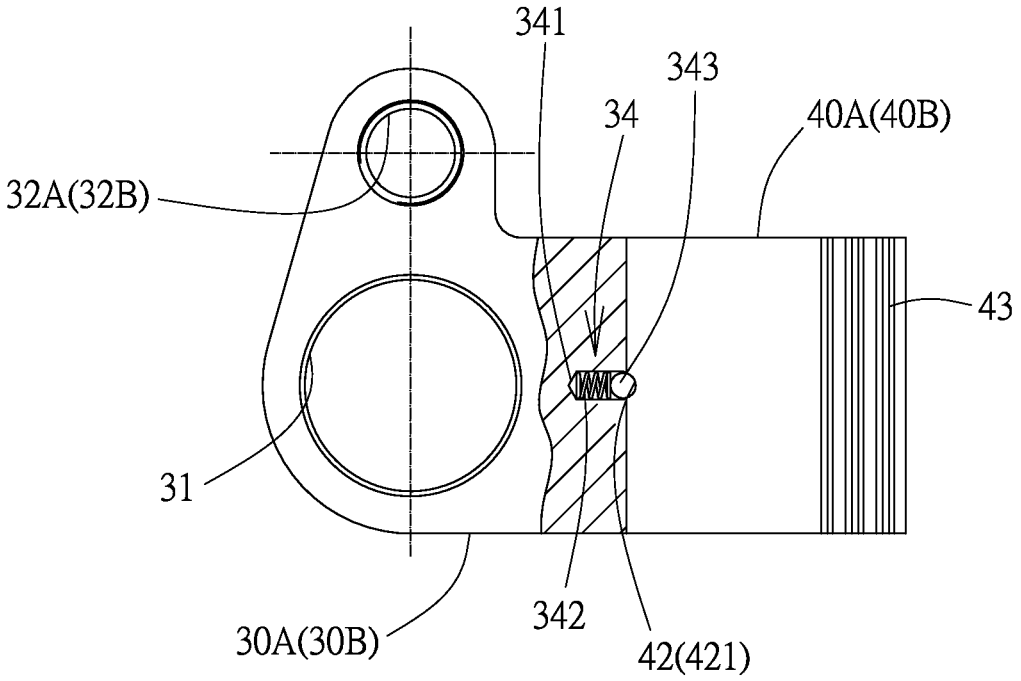
FIG. 4 is another cross sectional view showing the assembly of the two clamping members and the two paws of the removal device for the belt pulley according to the preferred embodiment of the present invention.
Figure 8:
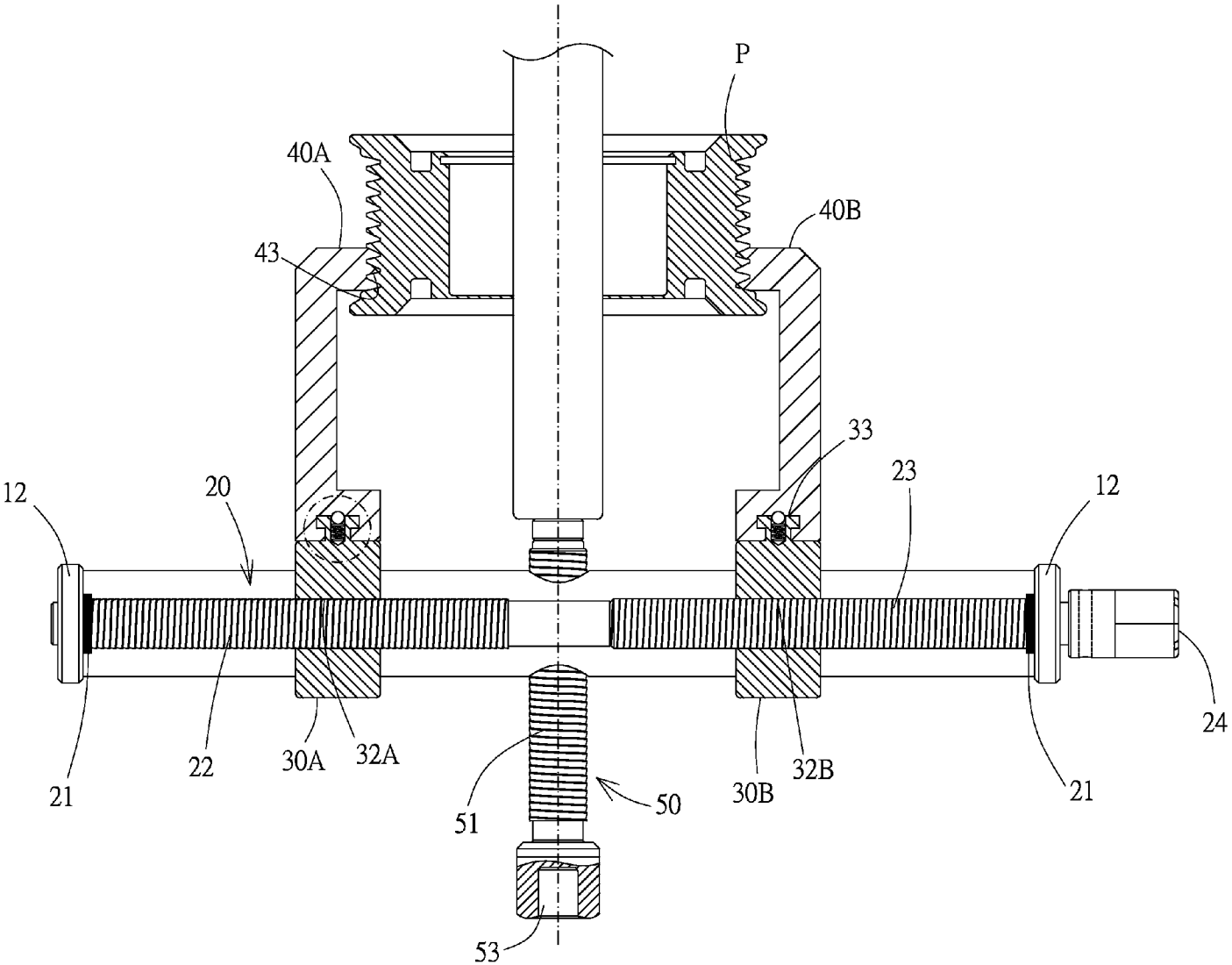
FIG. 8 is still another cross sectional view showing the operation of the removal device for the belt pulley according to the preferred embodiment of the present invention.

As shown in FIGS. 3 and 8, two second guide rails 41 of the first paw 40A and the second paw 40B retain with two first guide rails 33 of the first clamping member 30A and the second clamping member 30B, and the first paw 40A and the second paw 40B are in connection with the first clamping member 30A and the second clamping member 30B by using two first engaging portions 34 and two second engaging portions 42. As illustrated in FIG. 8, the first paw 40A and the second paw 40B of different sizes are replaced quickly and easily.

Preferably, the second direction A1 of the first guide rail 33 is perpendicular to the third direction A2 of the screwing hole 11 and the first direction A3 of the guiding rod 10, so when the push rod 50 moves to drive the first paw 40A and the second pas 40B to remove the belt pulley P, the two first guide rails 33 of the first clamping member 30A and the second clamping member 30B retain with the two second guide rails 41 of the first paw 40A and the second paw 40B securely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A removal device for a belt pulley comprising:

a guiding rod including a screwing hole defined on a central position thereof to screw with a push rod;

two clamping members sliding along the guiding rod, and each clamping member including a guide orifice for inserting the guiding rod, wherein each clamping member further includes a first guide rail and a first engaging portion, and a first direction of the first guide rail is perpendicular to a second direction of the screwing hole;

two paws, each including a second guide rail for matching with the first guide rail, such that each of the two paws is connected with or removed from each of the two clamping members, wherein the second guide rail has a second engaging portion for cooperating with the first engaging portion.

wherein a first clamping member has a first threaded aperture for screwing with a first threaded section, a second clamping member has a second threaded aperture for screwing with a second threaded section, such that the first clamping member and the second clamping member are symmetrically located beside two sides of the screwing hole so that a screw rod drives the first clamping member and the second clamping member to move close to or away from each other along the guiding rod;

wherein the guiding rod also includes two bearing holders mounted on two ends thereof, and the screw rod is fixed parallel to the guiding rod and two ends of the screw rod insert through and connect with the two bearing holders, the first threaded section and second threaded section of the screw rod are formed on the two ends of the screw rod to screw with the two bearing holders, wherein one of the two ends of the screw rod is inserted through one of the two bearing holders and has a first forcing portion for being rotated by a hand tool to revolve the screw rod.

2. The removal device for the belt pulley as claimed in claim 1, wherein the first direction of the first guide rail is perpendicular to a third direction of the guiding rod.

3. The removal device for the belt pulley as claimed in claim 1, wherein the first engaging portion has a first dead pore defined therein to accommodate a spring and a positioning ball pushed by the spring, such that a part of the positioning ball extends out of the first dead pore, and the second engaging portion has a second dead pore defined therein to retain with the positioning ball.

4. The removal device for the belt pulley as claimed in claim 1, wherein the screw rod includes two locking rings mounted inside the two bearing holders to limit a movement of the screw rod.

5. The removal device for the belt pulley as claimed in claim 1, wherein the push rod includes a third threaded section inserting through and screwing with the screwing hole and includes an abutting portion defined on a first end thereof between the first clamping member and the second clamping member, the push rod further includes a second forcing portion formed on a second end thereof and rotated by the hand tool.

6. The removal device for the belt pulley as claimed in claim 1, wherein the first guide rail is formed in a T shape.

* * * * *